US007055186B2

(12) United States Patent
Lauter et al.

(10) Patent No.: US 7,055,186 B2
(45) Date of Patent: Jun. 6, 2006

(54) COMBINATION SPA AND ENTERTAINMENT SYSTEM

(75) Inventors: Robert Lauter, Auburn, IN (US); Terry M. Valmassoi, Ft. Wayne, IN (US); Samuel K. Badiac, Ft. Wayne, IN (US); Elmer C. Herbert, Ft. Wayne, IN (US)

(73) Assignee: Master Spas, Inc., Ft. Wayne, IN (US)

( * ) Notice: Subject to any disclaimer, the term of this patent is extended or adjusted under 35 U.S.C. 154(b) by 217 days.

(21) Appl. No.: 10/286,280

(22) Filed: Nov. 1, 2002

(65) Prior Publication Data

US 2003/0088912 A1 May 15, 2003

Related U.S. Application Data

(60) Provisional application No. 60/332,861, filed on Nov. 6, 2001.

(51) Int. Cl.
*A47K 3/00* (2006.01)

(52) U.S. Cl. ..... 4/541.1; 4/559; 4/546; 4/541.2; 4/541.4

(58) Field of Classification Search ..... 4/541.1, 4/559, 546, 605, 566.1, 564.1, 541.2, 541.3, 4/541.4, 541.5
See application file for complete search history.

(56) References Cited

U.S. PATENT DOCUMENTS

| | | | | |
|---|---|---|---|---|
| 3,585,991 A | | 6/1971 | Balamuth | 128/66 |
| 3,680,936 A | | 8/1972 | Backhaus | 312/7 |
| 3,761,152 A | | 9/1973 | Cory | 312/7 TV |
| 4,151,804 A | | 5/1979 | Waché et al. | 108/147 |
| 4,151,971 A | | 5/1979 | Daly et al. | 248/286 |
| 4,568,132 A | | 2/1986 | Watt | 312/312 |
| 4,575,882 A | | 3/1986 | Diamond | 4/559 |
| D291,800 S | | 9/1987 | Morris | D14/33 |
| 5,129,611 A | | 7/1992 | Grover et al. | 248/688 |
| 5,165,126 A | | 11/1992 | Jones | 5/414 |
| 5,273,352 A | | 12/1993 | Saper | 312/7.2 |
| 5,321,760 A | | 6/1994 | Gray | 381/86 |
| 5,401,089 A | | 3/1995 | Inagaki et al. | 312/7.2 |
| 5,427,808 A | * | 6/1995 | Adams | 426/419 |
| 5,516,070 A | | 5/1996 | Chapman | 248/404 |
| 5,838,537 A | | 11/1998 | Lundgren et al. | 361/683 |
| 5,876,095 A | | 3/1999 | Johnston | 297/339 |
| 6,095,476 A | | 8/2000 | Mathis | 248/422 |
| 6,371,449 B1 | | 4/2002 | Chamberlain | 254/387 |
| 6,427,258 B1 | * | 8/2002 | Gooley | 4/566.1 |
| 6,467,103 B1 | | 10/2002 | Gardenier et al. | 4/541.1 |

FOREIGN PATENT DOCUMENTS

| | | | |
|---|---|---|---|
| JP | 2-61263 | | 3/1990 |
| JP | 2-285171 | | 11/1990 |
| JP | 404285511 A1 | * | 10/1992 |

* cited by examiner

*Primary Examiner*—Gregory Huson
*Assistant Examiner*—Azy Kokabi
(74) *Attorney, Agent, or Firm*—Synnestvedt & Lechner LLP

(57) ABSTRACT

A combination spa and electronic entertainment system is disclosed. The spa includes a tub with an upper edge from which horizontal surfaces extend. The surfaces have apertures through which water-tight housings may be raised and lowered. The housings hold components of the entertainment system and have tops larger in size than the apertures to form sealing areas engageable with the horizontal surfaces surrounding the apertures for sealing the apertures and the water-tight housings. A moving mechanism is provided to raise and lower the housings. The mechanism has a platform supported on a carriage movable vertically along a support column. A motor raises and lowers the platforms through a cable and pulley system. A motion limiting device having a pivoting arm which engages sensors communicating with the motor through a control system shuts the motor off in response to predetermined upper and lower limits of cable tension.

17 Claims, 3 Drawing Sheets

COMBINATION SPA AND ENTERTAINMENT SYSTEM

RELATED APPLICATION

This application is based on and claims the benefit of U.S. Provisional Application No. 60/332,861, filed Nov. 6, 2001.

FIELD OF THE INVENTION

This invention relates to aquatic spas for recreational and therapeutic use and to such spas in combination with an electronic entertainment system.

BACKGROUND OF THE INVENTION

Spas, also known as hot-tubs, find widespread use in homes, hotels, gymnasiums and hospitals as a means of relaxation or medical treatment by providing aquatic massage therapy to the muscles and joints of a person immersed in a bath of temperature controlled water. Water is heated and pumped within the spa which typically comprises a tub having a plurality of nozzles to direct jets of water wherever desired on the person to relieve tension, as well as joint and muscular pain.

Spas have evolved beyond a strictly functional device merely providing therapy to occupy a position as an appurtenance used in leisure time and as a vehicle promoting social activity. As such, it is desirable to incorporate or associate other devices, also associated with leisure and social activities, with the spa. Such devices may be broadly classified as an entertainment system and include, for example, televisions, radios, compact disc players video tape players and recorders, digital video disc players and their required accessories such as stereophonic speakers.

There is a problem in integrating such an entertainment system with a spa due to the presence of a reasonably large volume of water in which people are immersed and the fact that such systems are electronic in nature and require that electricity be supplied to power them. Unless proper precautions are taken, the combination of a spa with an entertainment system presents electrical hazards to the occupants of the spa, as well as potential damage to the various components of the entertainment system.

SUMMARY AND OBJECTS OF THE INVENTION

The invention concerns a combination spa and electronic entertainment system for personal therapy and relaxation by immersion of one or more people in a volume of water. The combination spa and entertainment system comprises a tub adapted to hold the water and accommodate one or more people for immersion therein. The tub comprises a bottom and a plurality of sidewalls surrounding the bottom, the sidewalls having an upper edge extending around the tub. A surface extends substantially horizontally from one of the sidewalls and proximate to the upper edge. The surface has an aperture therein. The aperture is preferably surrounded by a rib positioned on the surface and projecting outwardly from it. A water-tight housing defining an interior adapted to hold a component of the entertainment system is positioned within the aperture and is movable between a first position beneath the surface and a second position projecting above the surface. The housing has a cover projecting beyond the perimeter of the aperture, the cover comprising a sealing area facing the surface. The sealing area preferably has a groove spaced to coincide with the rib on the sealing area. The groove is sized to receive the rib and contribute to the effectiveness of the seal when the housing is in the first position beneath the surface. The combination further includes a mechanism for moving the housing between the first and the second positions, as well as a control system for controlling the moving mechanism.

Preferably, the housing holds a television monitor and has a transparent cover facing the tub permitting the monitor to be viewed by the people within the tub. In addition to the housing holding the monitor, the combination may also include a second surface extending substantially horizontally from another one of the sidewalls and proximate to the upper edge. The second surface has a second aperture therein, the second aperture being preferably surrounded by a second rib positioned on the second surface and projecting outwardly therefrom. A second water-tight housing defining an interior adapted to hold another component, such as an electronic speaker, is positioned within the second aperture and movable between a first position beneath the second surface and a second position projecting above the second surface. The second housing also has a cover projecting beyond the perimeter of the second aperture, the top comprising a second sealing area facing the second surface. The second sealing area preferably has a groove spaced to coincide with the rib on the sealing area. The groove is sized to receive the second rib and thereby contribute to effectiveness of the seal of the second aperture when the second housing is in the first position beneath the surface. The combination has a second mechanism for moving the second housing between the first and the second positions. Preferably, the second moving mechanism is controlled by the same control system as controls the first moving mechanism.

Preferably the moving mechanism comprises a first support column and a first carriage movably mounted on the first support column for movement in a substantially vertical direction. A first platform is mounted on top of the carriage, the platform adapted to support, for example, a water-tight housing to hold electronic components. A first pulley is rotatably mounted on the first support column and a second pulley rotatably mounted on the first carriage. A motor is operatively associated with the mechanism, the motor having or being coupled to a rotatable shaft. A control system is linked to the motor for controlling it. A cable is fixedly attached at one end to the support column, engages the first and the second pulleys, and is attached at its other end to the rotatable shaft. Turning of the shaft by the motor in one direction winds the cable about the shaft and draws the cable over the first and second pulleys, moving the carriage upwardly on the support column. Turning of the shaft in an opposite direction unwinds the cable from the shaft and allowing movement of the carriage downwardly under gravity on the support column.

Multiple mechanisms may be linked together to simultaneously raise and lower various housings. Preferably such multiple mechanisms would further include a second support column and a second carriage movably mounted on the second support column for movement in a substantially vertical direction. A second platform is mounted on top of the second carriage, the second platform also adapted to support a water-tight housing. A third pulley is rotatably mounted on the second support column and a fourth pulley is rotatably mounted on the second carriage. In addition, a fifth pulley is rotatably mounted and fixed in position between the first and second support columns. A second cable is fixedly attached at one end to the second support column and engages the third, the fourth and the fifth pulleys, the cable being attached at another end to the first carriage. Motion of the first carriage upwardly draws the second cable over the third, fourth and fifth pulleys and moves the second carriage upwardly on the second support column, motion of the first carriage downwardly allows movement of the second carriage downwardly under gravity on the second support column.

The mechanism may also include a motion limiting device. The preferred motion limiting device comprises a first sensor in communication with the control system and capable of generating a signal indicative of a cable tension less than a first predetermined level and a second sensor in communication with the control system and capable of generating a signal indicative of a cable tension greater than a second predetermined level. A movable member is engaged with the cable and movable into a first position in engagement with the first sensor when tension in the cable is less than the first predetermined level, and into a second position in engagement with the second sensor when tension in the cable is greater than the second predetermined level. Engagement of the movable member with either of the first and the second sensors causes a signal to be generated and communicated to the control system, the control system halting the motor in response to the signal.

It is an object of the invention to provide a spa combined with an electronic entertainment system.

It is another object of the invention to provide a spa wherein the components of an electronic entertainment system may be raised and lowered between a hidden position beneath the surface of the spa structure and above the surface for use by persons in the spa.

It is yet another object of the invention to provide a mechanism for raising and lowering the components of the entertainment system.

It is still another object of the invention to provide a mechanism for raising and lowering multiple components of an entertainment system.

It is further another object of the invention to provide a mechanism for limiting the motion of the mechanism for raising and lowering the components of the entertainment system.

It is again another object of the invention to provide a sealing system for safely positioning electrical and electronic components proximate to a body of water.

These and other objects and advantages of the invention will become apparent upon consideration of the drawings and detailed description of preferred embodiments.

DETAILED DESCRIPTION OF THE PRESENTLY PREFERRED EMBODIMENTS

Figure 1:
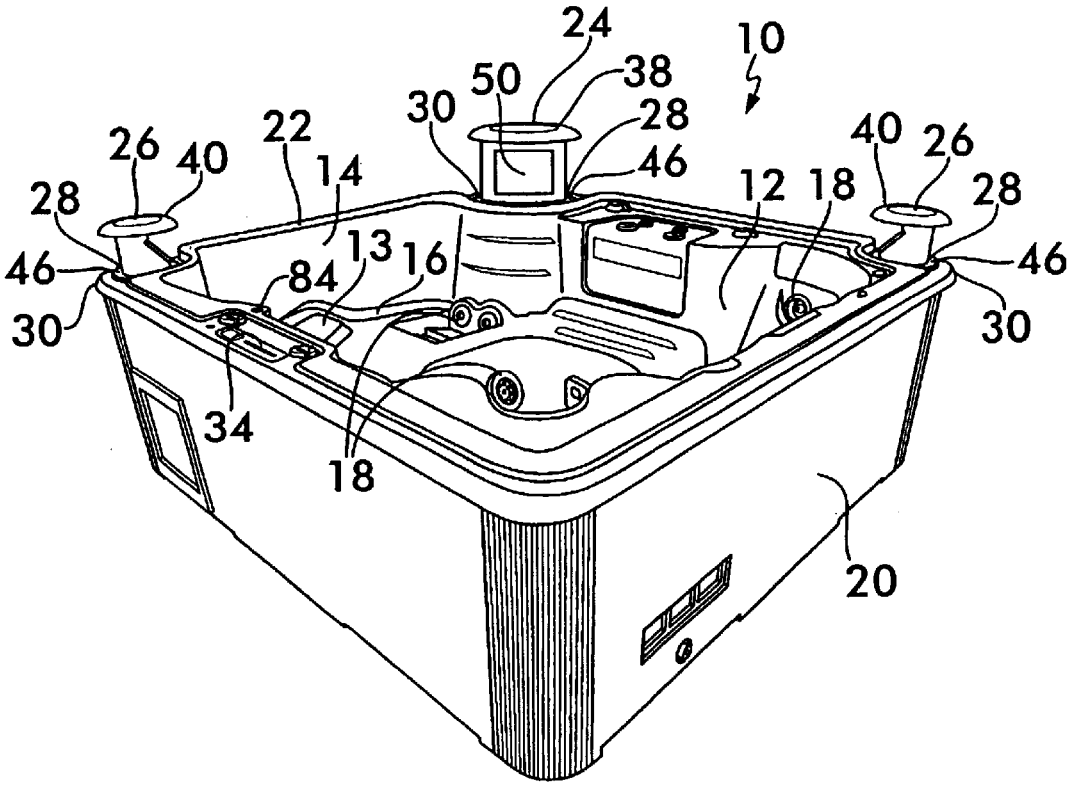
FIG. 1 is a perspective view of a combination spa and entertainment system according to the invention.

FIG. 1 shows a perspective view of the combination spa and electronic entertainment system 10. The spa portion comprises a tub 12 having a plurality of sidewalls 14 surrounding a bottom 16. The bottom 16 as well as the sidewalls 14 have a plurality of nozzles and jets 18 through which heated water is pumped and directed to impinge upon muscles and joints of people immersed within the volume of water held by the tub 12. Pumps, piping, heater elements, valves and other apparatus for running the spa are preferably positioned beneath and along side the tub and hidden by a skirt 20 extending downwardly from the upper edge 22 surrounding the tub 12. The components for running the spa are well understood by those of skill in the art and need not be shown in detail.

Figure 2:
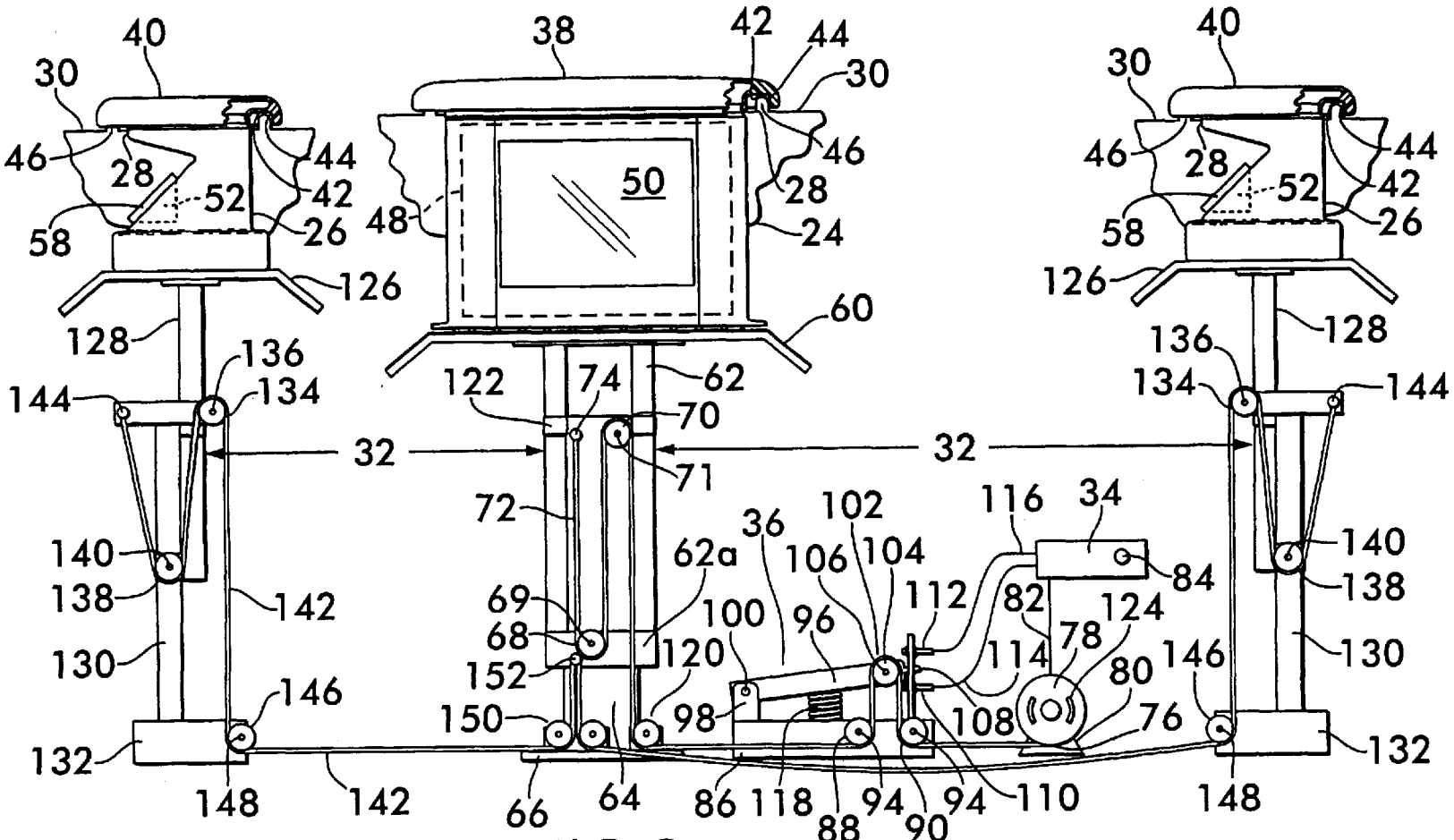
FIG. 2 is a schematic view of the internal components comprising the entertainment system shown in FIG. 1.

The electronic components comprising the entertainment system are contained in water-tight housings, such as 24 for holding a television monitor and 26 for holding a speaker. Each housing is mounted within an aperture 28 in a respective surface 30 which extends substantially horizontally from one of the sidewalls 14, the upper surfaces 30 being positioned near to the upper edge 22 of the tub 12. As shown in FIG. 2, each housing 24 and 26 has a mechanism 32 for moving the housings between a first position, shown in FIG. 2, wherein the housings are substantially beneath the surfaces 30, and a second position, shown in FIG. 1, wherein the housings project substantially above the surfaces 30 allowing the electronic components positioned within the housings to be used by the occupants of the spa. A preferred form of a moving mechanism is described in detail below. A control system 34 (shown in FIG. 1 and schematically in FIG. 2) and a motion limiting device 36 are operatively associated with the moving mechanism 32 allowing the occupants of the spa to raise and lower the water-tight housings as desired. Control system 34 may also be used to control the various functions of the spa, such as the water temperature, as well as the operation of the various jets and nozzles 18.

Figure 3:
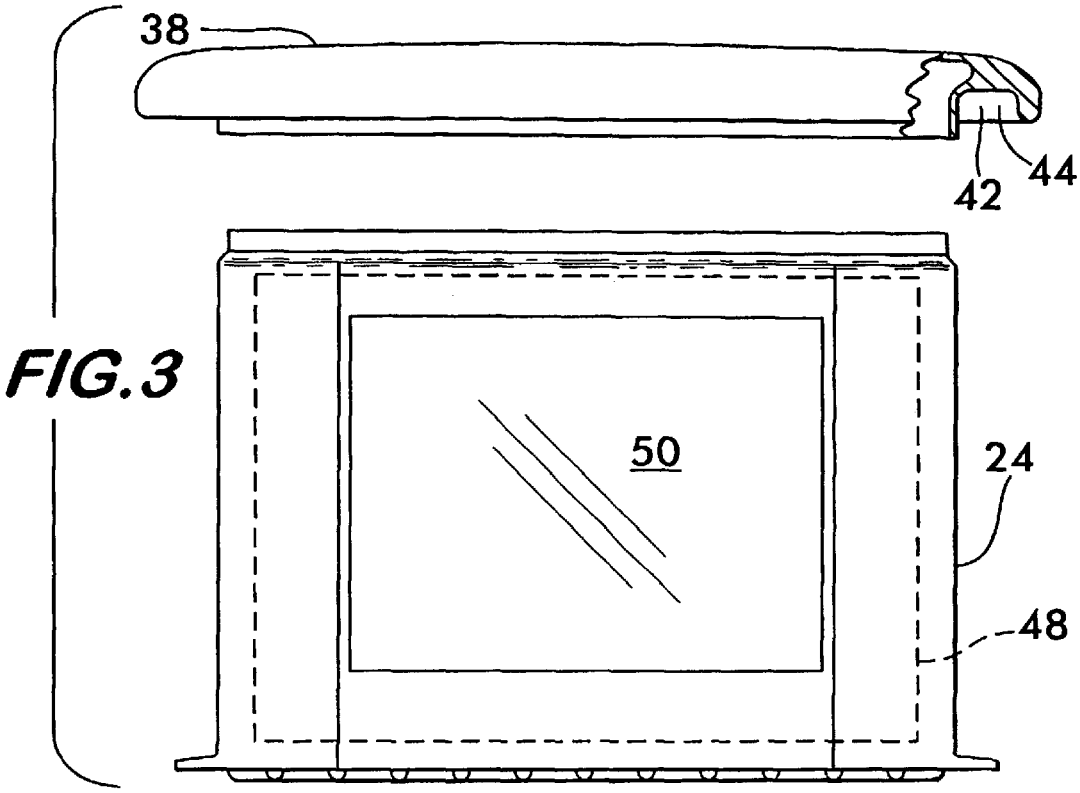
FIG. 3 is a front view of a component shown in FIG. 2.
Figure 4:
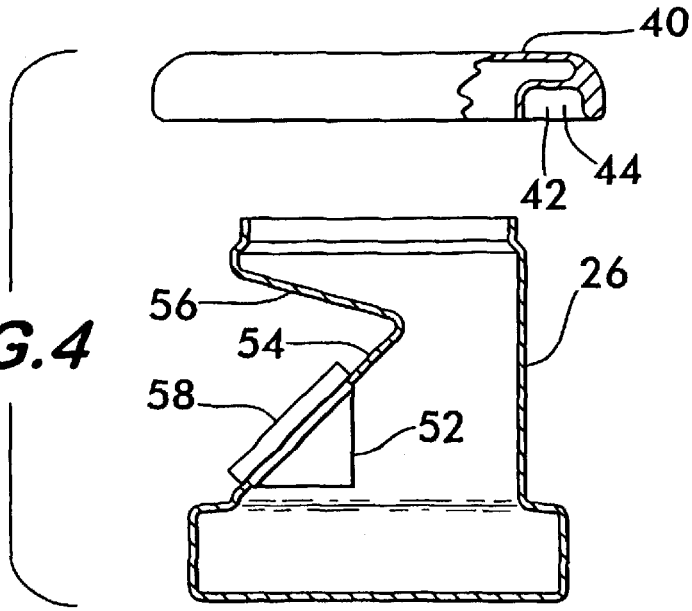
FIG. 4 is a sectional side view of a component shown in FIG. 2.

As shown in FIGS. 3 and 4, water-tight housings 24 and 26 each have a respective cover 38 and 40 adapted to enclose the housing. Covers 38 and 40 are larger in size than the apertures 28 in the surfaces 30 (see FIG. 2) and project beyond the perimeter of the apertures, the excess cover portion extending outwardly and forming a sealing area 42 which faces surfaces 30 and will not pass through the apertures through which the housings move. Each sealing area 42 preferably has a groove 44 extending substantially around the cover, the groove being engageable with a complementary rib 46 (see FIGS. 1 and 2) positioned on each surface 30. The ribs 46 project outwardly from each surface 30 and substantially surround each aperture 28 to present a raised barrier preventing water from draining into the apertures when the housings are in the second position extending from the surfaces (FIG. 1). Grooves 44 in the sealing areas 42 of covers 38 and 40 are adapted to accommodate the rib and close off the apertures 28 when the housings are in the first position beneath the surfaces 30 (FIG. 2) to prevent water from entering the apertures and the water-tight housings 24 and 26.

Water-tight housing 24 is preferably formed of high-strength plastic and adapted to hold and protect a television monitor 48 shown schematically in dashed line in FIG. 3. The television may be connected to a cable network, as well as any other components of the entertainment system, such as a video tape recorder/player, a digital video disk system and the like. The television is operated by a remote control unit by the occupants of the spa. The housing 24 has a transparent cover 50 which faces the tub to permit viewing of the television 48 by the occupants within the tub.

Water-tight housing 26, shown in FIG. 4, is preferably also made of high-strength plastic adapted to hold a speaker 52 shown schematically in dashed line. The housing 26 has an angled surface 54 which faces a contra-angled surface 56. Both surfaces face the tub 12. Angled surface 54 has a speaker grating 58 mounted thereon for protecting the speaker, and the angled surface helps drain water away from the speaker. Contra surface 56 acts as a reflector to direct sound from the speaker toward the area of the tub so it can be heard by the occupants.

As shown in FIG. 1, tub 12 comprises a seat 13 for accommodating a person in the spa 10. Seat 13 faces housing 24 allowing for convenient viewing of the television monitor. Housing 26 is positioned substantially behind seat 13 and is thus substantially behind a person viewing the television monitor. This allows the speaker to be readily heard by an occupant of seat 13.

As shown in FIG. 2, the water-tight housings 24 and 26 are positioned on a preferred embodiment of the moving mechanism 32 which raises and lowers them above and below the surfaces 30 as desired by the occupants of the tub 12 through the use of a control system 34.

Other embodiments of the moving mechanism, using hydraulic or pneumatic components, as well as other forms of mechanical components, are also feasible. The preferred moving mechanism supporting water-tight housing 24 holding the television 48 comprises a platform 60 mounted on a carriage 62 which is slidably movable along and guided by a support column 64 which is mounted to the ground by a base plate 66. A pulley 68 is rotatably mounted on the carriage 62 and is rotatable about a horizontal axis 69. Another pulley 70 is mounted on the support column 64 and rotatable about a horizontal axis 71. A cable 72 has one end 74 fixed to the support column 64 and is routed over the pulleys 68 and 70. The other end 76 of cable 72 is attached to a rotatable shaft 78 driven by a motor 80, preferably electrically powered. The motor is controlled by the control system 34 through a communication link 82.

When it is desired to raise the television for viewing, an occupant of the tub 12 presses a button 84 on the control system 34 which activates motor 80 through the communication link 82. Motor 80 turns and winds cable 72 onto shaft 78. The winding of cable 72 onto the shaft draws the cable over the pulleys 68 and 70 which rotate about their respective axes causing carriage 62 to slide upwardly along support column 64 and move the housing 24 containing television 48 from its position shown in FIG. 2 beneath surface 30 to its position shown in FIG. 1 above surface 30 for viewing by the tub occupants. To lower the television, the same button may be pushed to reverse motor 80 which then unwinds the cable from the shaft 78. The carriage 62 slides downwardly along support column 64 under gravity until the groove 44 in cover 38 engages the rib 46 in surface 30 to close off aperture 28.

The limits of motion of the carriage 62 are determined by motion limiting device 36 best shown in FIG. 2. Motion limiting device 36 comprises a base 86 having two pulleys 88 and 90 mounted thereon and rotatable about respective horizontal axes 92 and 94. A movable member, preferably an arm 96 has one end 98 pivotally attached to base 86 for pivoting movement about a horizontal axis 100. The other end 102 of arm 96 has a pulley 104 mounted thereon for rotation about a horizontal axis 106. Pulleys 88, 90 and 104 are positioned in substantially the same vertical plane. A finger 108 extends from end 102 of arm 96 and is engageable with two sensors, preferably in the form of limit switches, namely, an upper motion limit switch 110 and a lower motion limit switch 112. The limit switches are connected to the control system 34 through respective feedback links 114 and 116. A biasing member, preferably a compression spring 118, is positioned between ends 98 and 102 of the movable arm 96, the spring 118 biasing the arm away from base 86.

Cable 72 is directed from pulley 70 on support column 64 through an idler pulley 120 and loops under pulley 88, over pulley 104 and back under pulley 90 before engaging shaft 78 on motor 80. The motion limiting device 36 operates as follows. When button 84 is pressed to raise television 48, motor 80 turns shaft 78 to wind the cable 72 about the shaft. This causes carriage 62 to rise as described above. When the bottom portion 62*a* of the carriage encounters a stop 122 on support column 64, further motion of the carriage is prevented. The motor continues to turn however and increases the tension on cable 72 causing arm 96 to pivot downwardly about axis 100 against spring 118 until finger 108 engages the upper motion limit switch 110. Closing of this switch is communicated to control system 34 by feedback link 114, the control system then stopping motor 80 and applying a brake 124 to the motor or the shaft 78 to hold the carriage in the raised position. The spring constant of spring 118 is chosen to allow sufficient tension to develop in cable 72 to raise the television without tripping the limit switch but will prevent significant excess tension, which occurs, for example, when the carriage encounters stop 122 or if a heavy object is positioned on top of cover 38 preventing motion of the housing 24 above the surface 30.

When it is desired to lower the television, button 84 is pressed, releasing brake 124 and reversing motor 80 to unwind the cable 72 from the shaft 78. The carriage 62 slides downwardly along support column 64 under gravity and keeps enough tension in the cable 72 to compress biasing spring 118 and prevent finger 108 from engaging lower limit motion switch 112 prematurely. Once the carriage 62 bottoms out and can move no further downwardly, the motor continues to turn, further relieving tension in cable 72 and allowing arm 96 to pivot upwardly about axis 100 under the force of biasing spring 118 until finger 108 engages lower limit motion switch 112. Closing of switch 112 is communicated to control system 34 by feedback link 116 and the control system shuts off motor 80.

Moving mechanism 32 also raises and lowers speakers 52 in housings 26. A housing 26 is supported on a platform 126 mounted on a carriage 128 slidably movable along and guided by a support column 130. Support column 130 is mounted on a base 132 and has a pulley 134 mounted thereon for rotation about a horizontal axis 136. Another pulley 138 is mounted on carriage 128 and is rotatable about a horizontal axis 140. A cable 142 has one end 144 fixed to support column 130. Cable 142 is routed around pulleys 138 and 134 to an idler pulley 146 on base 132, the idler pulley being rotatable about a horizontal axis 148. Cable 142 continues toward support column 64 and is routed around another idler pulley 150 mounted on base 66 and also rotatable about a horizontal axis. The other end 152 of cable 142 is attached to carriage 62. Thus, when motor 80 raises carriage 62 as described above the motion of the carriage 62 draws cable 142 along pulleys 138, 134, 146 and 150 to also slide carriage 128 upwardly along support column 130 to raise speaker 52 in housing 26 above surface 30 simultaneously with the television. Similarly, when the carriage 62 is lowered carriage 128 will also be lowered as cable 142 is payed out due to the downward motion of carriage 62. As shown in FIG. 2, multiple speakers 52 may be raised and lowered by using multiple cables connected to the carriage 62. It is interesting to note that the speed at which the speakers rise is approximately half the speed at which the television rises due to the pulley configuration.

Figure 5:
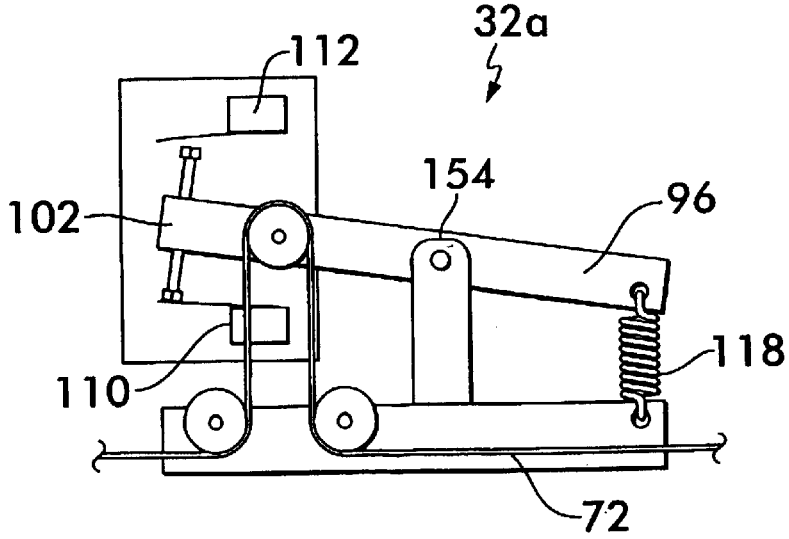
FIG. 5 is a schematic view of an alternate embodiment of a mechanism shown in FIG. 2.

FIG. 5 shows an alternate embodiment of the motion limiting device 32*a* wherein the pivot point 154 of arm 96 is positioned between the spring 118 and the end 102 of the arm engaging the limit upper and lower motion limit switches 110 and 112. Operation of the motion limiting device 32*a* is similar to that described above for device 32, it being noted that spring 118 is used as a tension spring in device 32*a*.

The combination spa and entertainment system according to the invention promises to improve the safety and reliability of operation of the spa and thereby promote it as a form of relaxation and therapy.

What is claimed is:

1. A combination spa and electronic entertainment system for personal therapy and relaxation by immersion in a volume of water, said spa and entertainment system comprising:

a tub adapted to hold said water and accommodate at least one person for immersion therein, said tub comprising a bottom and a plurality of sidewalls surrounding said bottom, said sidewalls having an upper edge extending around said tub;

a first surface extending substantially horizontally from one of said sidewalls and proximate to said upper edge, said first surface having a first aperture therein;

a first water tight housing defining an interior adapted to hold a television monitor, said housing having a transparent cover facing said tub permitting said monitor to be viewed by persons within said tub, said first housing being positioned in alignment with said first aperture and movable between a first position beneath said first surface and a second position projecting above said first surface, said first housing having a cover projecting beyond the perimeter of said first aperture and comprising a first sealing area facing said first surface, said first sealing area being engageable with said first surface to effect a seal around the perimeter of said first aperture thereby keeping water out of said interior when said first housing is in said first position beneath said first surface;

a first mechanism adapted for moving said first housing between said first and said second positions;

a second surface extending substantially horizontally from one of said sidewalls and proximate to said upper edge, said second surface having a second aperture therein;

a second water-tight housing defining an interior adapted to hold a component of said entertainment systems said second housing being positioned within said second aperture and movable between a first position beneath said second surface and a second position projecting above said second surface, said second housing having a cover projecting beyond the perimeter of said second aperture and comprising a second sealing area facing said second surface, said second sealing area being engageable with said second surface thereby keeping water out of said second aperture when said second housing is in said first position beneath said second surface;

a second mechanism adapted for moving said second housing between said first and said second positions simultaneously with said first housing; and a control system for controlling said first and second mechanisms.

2. A combination spa and electronic entertainment system according to claim 1, further comprising a rib positioned surrounding said aperture on said surface and projecting outwardly therefrom, said sealing area having a complementary groove spaced to coincide with the rib on the sealing area, the groove being sized to receive said rib and thereby seal said aperture when said housing is in said first position beneath said surface.

3. A combination spa and electronic entertainment system according to claim 1, further comprising a rib surrounding said second aperture on said second surface and projecting outwardly therefrom, said second sealing area having a complementary groove spaced to coincide with the rib on said sealing area, said groove being sized to receive said rib and thereby seal said second aperture when said second housing is in said first position beneath said second surface.

4. A combination spa and electronic entertainment system according to claim 1, wherein said other component of said electronic entertainment system comprises a speaker.

5. A combination spa and electronic entertainment system according to claim wherein said second housing comprises:

an angled surface adapted for mounting said speaker thereon, said angled surface substantially facing toward said tub; and a contra-angled surface substantially facing said angled surface, said contra-angled surface adapted for reflecting sound from said speaker toward said tub.

6. A combination spa and electronic entertainment system according to claim 5 further comprising a seat adapted to accommodate a person and positioned within said tub facing said first housing, said second housing being positioned substantially behind said seat.

7. A combination spa and electronic entertainment system for personal therapy and relaxation by immersion in a volume of water, said spa and entertainment system comprising:

a tub adapted to hold said water and accommodate at least one person for immersion therein, said tub comprising a bottom and a plurality of sidewalls surrounding said bottom, said sidewalls having an upper edge extending around said tub;

a surface extending substantially horizontally from one of said sidewalls and proximate to said upper edge, said surface having an aperture therein;

a water-tight housing defining an interior adapted to hold a component of said entertainment system, said housing being positioned in alignment with said aperture and movable between a first position beneath said surface and a second position projecting above said surface, said housing having a cover projecting beyond the perimeter of said aperture and comprising a sealing area facing said surface, said sealing area being engageable with said surface to effect a seal around the perimeter of said aperture thereby keeping water out of said interior when said housing is in said first position beneath said surface;

a mechanism adapted for moving said housing between said first and said second positions, said mechanism comprising a support column positioned beneath said surface;

a carriage movably mounted on said support column for movement in a substantially vertical direction;

a platform mounted on top of said carriage in alignment with said aperture, said water-tight housing being mounted on said platform and movable between said first and second positions upon movement of said carriage on said support column;

a motor for raising and lowering said carriage;

a transmission system linking said motor with said carriage; and a control system for controlling said mechanism.

8. A combination spa and electronic entertainment system according to claim 7, wherein said transmission system comprises:

a first pulley rotatably mounted on said support column;

a second pulley rotatably mounted on said carriage;

a rotatable shaft powered by said motor and fixedly mounted beneath said surface; and a cable fixedly attached at one end to said support column and engaging said first and said second pulleys, said cable being attached at another end to said rotatable shaft, turning of said shaft in one direction winding said cable about said shaft and drawing said cable over said first and second pulleys thereby moving said carriage upwardly on said support column, turning of said shaft in an opposite direction unwinding said cable from said shaft and allowing movement of said carriage downwardly under gravity on said support column.

9. A combination spa and electronic entertainment system according to claim further comprising:

a second surface extending substantially horizontally from one of said sidewalls and proximate to said upper edge, said second surface having a second aperture therein;

a second water-tight housing defining an interior adapted to hold another component of said entertainment system, said second housing being positioned within said second aperture and movable between a first position beneath said second surface and a second position projecting above said second surface, said second housing having a top larger in size than said second aperture and comprising a second sealing area facing said second surface, said second sealing area being engageable with said second surface thereby keeping water out of said second aperture when said second housing is in said first position beneath said second surface; and a second mechanism adapted for moving said second housing between said first and said second positions simultaneously with said first housing.

10. A combination spa and electronic entertainment system according to claim 9, further comprising a rib positioned surrounding said second aperture on said second surface and projecting outwardly therefrom, said second sealing area having a complementary groove therein sized to accommodate said rib and thereby seal said second aperture when said second housing is in said first position beneath said second surface.

11. A combination spa and electronic entertainment system according to claim 9, herein said other component of said electronic entertainment system comprises a speaker.

12. A combination spa and electronic entertainment system according to claim 9, said second mechanism for moving said second housing comprises:

a second support column positioned beneath said second surface;

a second carriage movably mounted on said second support column for movement in a substantially vertical direction;

a second platform mounted on top of said second carriage in alignment with said second aperture, said second water-tight housing being mounted on said second platform and movable between said first and second positions upon movement of said second carriage on said second support column; and a second transmission system linking said first carriage with said second carriage.

13. A combination spa and electronic entertainment system according to claim 12 wherein said second transmission system comprises:

a third pulley rotatably mounted on said second support column;

a fourth pulley rotatably mounted on said second carriage;

a fifth pulley rotatably mounted and fixed positioned beneath one of said first and second surfaces; and a second cable fixedly attached at one end to said second support column and engaging said third, said fourth and said fifth pulleys, said cable being attached at another end to said first carriage, motion of said first carriage upwardly drawing said second cable over said third, fourth and fifth pulleys and moving said second carriage upwardly on said second support column, motion of said first carriage downwardly allowing movement of said second carriage downwardly under gravity on said second support column.

14. A combination spa and electronic entertainment system according to claim 8, further including a motion limiting device comprising:

a first sensor in communication with said control system and capable of generating a signal indicative of a cable tension less than a first predetermined level;

a second sensor in communication with said control system and capable of generating a signal indicative of a cable tension greater than a second predetermined level; and a movable member engaged with said cable and movable into a first position in engagement with said first sensor when tension in said cable is less than said first predetermined level, and into a second position in engagement with said second sensor when tension in said cable is greater than said second predetermined level, engagement of said movable member with either of said first and said second sensors causing a signal to be generated and communicated to said control system, said control system halting said motor in response to said signal.

15. A combination spa and electronic entertainment system according to claim 14, wherein said movable member comprises:

an elongated arm having one end positioned between said first and second sensors, said arm being pivotally mounted and allowing motion of said one end in a first direction into engagement with said first sensor, and in a second direction into engagement with said second sensor;

a biasing member for biasing said one end of said arm into engagement with one of said sensors; and a pair of fixed pulleys rotatably mounted in respective fixed positions adjacent to said arm and a movable pulley rotatably mounted on said arm, said fixed and said movable pulleys being adapted to engage said cable at a position between said carriage and said motor, said cable passing over one of said fixed pulleys, said movable pulley and the other of said fixed pulleys, whereby motion of said shaft lowering said housing to said first position results in tension in said cable less than said first predetermined value thereby allowing said arm to be biased by said biasing member into engagement with one of said sensors, said one sensor generating said signal to said control system, said control system halting said motor in response thereto, motion of said shaft raising said housing into said second position results in tension in said cable greater than said second predetermined level thereby pivoting said arm against said biasing member into engagement with the other of said sensors, said other sensor generating a signal to said control system, said control system halting said motor in response thereto.

16. A combination spa and electronic entertainment system according to claim 15, wherein said first and second sensors comprise micro switches.

17. A combination spa and electronic entertainment system according to claim 15, wherein said biasing member comprises a spring.

* * * * *

UNITED STATES PATENT AND TRADEMARK OFFICE

CERTIFICATE OF CORRECTION

PATENT NO. : 7,055,186 B2
APPLICATION NO. : 10/286280
DATED : June 6, 2006
INVENTOR(S) : Lauter et al.

It is certified that error appears in the above-identified patent and that said Letters Patent is hereby corrected as shown below:

Column 8, line 18, claim 5 should be dependent upon claim 4.

Column 9, line 24, claim 9 should be dependent upon claim 8.

Signed and Sealed this

Seventh Day of November, 2006

JON W. DUDAS
*Director of the United States Patent and Trademark Office*